US008665205B2

(12) United States Patent
Honbo

(10) Patent No.: US 8,665,205 B2
(45) Date of Patent: Mar. 4, 2014

(54) METHOD OF DRIVING THE BACKLIGHT OF A LIGHT-EMITTING REGION OF AN LCD DEVICE TO REDUCE THE INFLUENCE OF LIGHT LEAKED FROM NEIGHBORING LIGHT-EMITTING REGIONS

(71) Applicant: NLT Technologies, Ltd., Kanagawa (JP)

(72) Inventor: Nobuaki Honbo, Kanagawa (JP)

(73) Assignee: NLT Technologies, Ltd., Kanagawa (JP)

( * ) Notice: Subject to any disclaimer, the term of this patent is extended or adjusted under 35 U.S.C. 154(b) by 0 days.

(21) Appl. No.: 13/893,866

(22) Filed: May 14, 2013

(65) Prior Publication Data

US 2013/0249973 A1 Sep. 26, 2013

Related U.S. Application Data

(62) Division of application No. 12/169,337, filed on Jul. 8, 2008, now Pat. No. 8,456,412.

(30) Foreign Application Priority Data

Jul. 9, 2007 (JP) ..... 2007-180344

(51) Int. Cl.
*G09G 3/36* (2006.01)

(52) U.S. Cl.
USPC ..... 345/102

(58) Field of Classification Search
USPC ..... 345/87–104, 204–215, 690–699
See application file for complete search history.

(56) References Cited

U.S. PATENT DOCUMENTS

| | | | | |
|---|---|---|---|---|
| 2003/0016205 | A1* | 1/2003 | Kawabata et al. | 345/102 |
| 2005/0184952 | A1* | 8/2005 | Konno et al. | 345/102 |
| 2007/0002000 | A1* | 1/2007 | Kwon | 345/102 |
| 2008/0007512 | A1* | 1/2008 | Honbo | 345/102 |
| 2008/0278432 | A1* | 11/2008 | Ohshima | 345/102 |

FOREIGN PATENT DOCUMENTS

| | | | |
|---|---|---|---|
| CN | 1838220 | A | 9/2006 |
| CN | 1908748 | A | 2/2007 |
| JP | 2002-099250 | A | 4/2002 |
| JP | 2004-286971 | A | 10/2004 |

(Continued)

OTHER PUBLICATIONS

[SID 04 Digest p. 1548] 59.4: Adaptive Dynamic Image Control for IPS-Mode LCD TV Ki- Duk Kim et al, (2004).

(Continued)

*Primary Examiner* — Chanh Nguyen
*Assistant Examiner* — Navin Lingaraju
(74) *Attorney, Agent, or Firm* — Sughrue Mion, PLLC

(57) ABSTRACT

There is provided a method of driving a backlight of a liquid crystal display device capable of eliminating leakage of light from adjacently-placed light emitting blocks. A gray level and maximum gray level of an input video signal are inputted for every light-emitting block. An output average gray level is calculated and a lighting control signal corresponding to converted luminance is outputted. The drivers responding to the lighting control signal makes LEDs (Light Emitting Diodes) emit light. An average gray level from an output from sensors is calculated. An average gray level, based on an average gray level and a light leakage rate, by taking light leakage into consideration. A gray level correcting signal is outputted in the light-emitting block based on the above output average gray level. An output average gray level is corrected in response to a gray level correcting signal.

18 Claims, 5 Drawing Sheets

(56) References Cited

FOREIGN PATENT DOCUMENTS

| | | | |
|---|---|---|---|
| JP | 2005-241678 | A | 9/2005 |
| JP | 2005-258403 | A | 9/2005 |
| JP | 2005-258404 | A | 9/2005 |
| JP | 2005-331644 | A | 12/2005 |
| JP | 2006-303016 | A | 11/2006 |
| JP | 2007-052105 | A | 3/2007 |
| JP | 2007-122014 | A | 5/2007 |
| JP | 2007-148331 | A | 6/2007 |
| WO | 2005/111976 | A1 | 11/2005 |
| WO | 2008/096469 | A1 | 8/2008 |

OTHER PUBLICATIONS

SID 05 Digest p. 1380 40.2: RGB Color Control System for LED Backlights in IPS-LCD TVs A. Konno et al, (2005).

Chinese Office Action issued Oct. 18, 2011 in corresponding Chinese Patent Application No. 200810135660.5.

Office Action issued by Japanese Patent Office in Japanese Patent Application No. 2007-180344 dated Jun. 12, 2012.

* cited by examiner

METHOD OF DRIVING THE BACKLIGHT OF A LIGHT-EMITTING REGION OF AN LCD DEVICE TO REDUCE THE INFLUENCE OF LIGHT LEAKED FROM NEIGHBORING LIGHT-EMITTING REGIONS

INCORPORATION BY REFERENCE

This is a divisional application based upon U.S. patent application Ser. No. 12/169,337, filed Jul. 8, 2008 and claims the benefit of priority from Japanese Patent Application No. 2007-180344, filed on Jul. 9, 2007, the disclosure of which is incorporated herein in its entirely by reference.

BACKGROUND OF THE INVENTION

1. Field of the Invention

The present invention relates to a method of driving a backlight of a liquid crystal display device, backlight driving device, and liquid crystal display device and more particularly to the method of driving the backlight of the liquid crystal display device being effective, when the backlight is divided into a plurality of light-emitting regions to illuminate a liquid crystal panel, in reducing an influence by light leaked from other light-emitting regions to one light-emitting region, the backlight driving device using the method, and the liquid crystal display device capable of reducing the influence by the light leakage.

2. Description of the Related Art

Conventionally, in an image display device of a television set or a like, a CRT (Cathode Ray Tube) is used. Owing to technological development thereafter, in recent years, various types of display devices are employed. These display devices include a liquid crystal display device. In the liquid crystal display, its liquid crystal panel itself is non-luminous and, therefore, a backlight is placed as a light source on a rear side of the liquid crystal panel and, by controlling transmittance of the liquid crystal panel according to an image signal, an image is displayed on a display surface.

The backlight employed in the liquid crystal display device is ordinarily used in its lighted state. As a result, if the whole display area is divided into a plurality of display regions and there is a given display region where black is to be displayed on a display surface of the liquid crystal panel, the given display region is made the brighter due to light leaked from other display regions surrounding the given display region. This is unlike a case where black is displayed by the CRT or a like which light emission is directly controlled. As a means to resolve the disadvantage, a method is available where luminance of a backlight is controlled according to an image signal to improve contrast (Non-patent References 1 [SID (the Society for Information Display) 04 DIGEST p 1548] and 2 [SID 05 DIGEST p 1380]).

An example is disclosed in Patent Reference 1 (Japanese Patent Application Laid-open No. 2005-258404). A liquid crystal display device disclosed in the Patent Reference 1 is so configured that, when an image based on an input image signal is displayed on a display surface of a liquid crystal panel while the liquid crystal panel is being illustrated by a backlight from a rear side of the liquid crystal panel, display data for every color to be applied to the liquid crystal panel and an amount of light emission of every color of the backlight are simultaneously controlled according to an image signal for every color of an input image signal and an output signal from an optical sensor which detects light emission from the backlight. Then, a controller used to exert control of the above performs a conversion of a gray level of an image to be displayed on the liquid crystal panel and luminance of the backlight. Therefore, the liquid crystal display device performs dynamic contrast control configured to change luminance of the backlight according to an image signal to be displayed on the liquid crystal panel. To exert the dynamic contrast control, an LED (Light Emitting Diode) of Red, Green, and Blue is used as the backlight, which serves to widen a chromaticity region and to increase modulation of a color (color hue) in an image memory.

Moreover, according to the disclosure in the Patent Reference 2 (Japanese Patent Application Laid-open No. 2007-052105), the backlight of the liquid crystal display device is divided into a plurality of light-emitting regions and an optical sensor is placed in every light-emitting region. This optical sensor measures light emission from the backlight for every light having passed through a color filter and controls, based on the measurement result, the light emission intensity of an LED making up the backlight in every light-emitting region and in every light-emission color.

However, in the configurations described in the above Patent Reference 1, the dynamic contrast control is exercised on the entire liquid crystal panel. Therefore, the related technology has a problem in that, when an image is to be displayed on the liquid crystal panel according to an image signal, if it is desired that an LED having high luminance and another LED having low luminance serving as the backlight exist in a mixed manner, light from the LED having high luminance leaks into a region corresponding to the LED whose luminance is required to be lowered and, as a result, it is impossible to fully lower the luminance of the light-emitting region corresponding to the LED whose luminance is required to be lowered.

Therefore, it is desirous that a backlight has a structure in which no light leakage occurs. However, by simply applying the division of light-emitting regions disclosed in the Patent Reference 2 as a method of reducing the light leakage, the complete elimination of the light leakage to the light-emitting region from other adjacently-placed light-emitting regions is difficult. Also, since the light emission intensity of an LED changes depending on a change in temperatures, it is difficult to avoid a change in color hue occurring while the dynamic contrast control is exerted.

SUMMARY OF THE INVENTION

In view of the above, it is an exemplary object of the present invention to provide a backlight driving method of a liquid crystal display device capable of eliminating an influence by leaked light into one light-emitting region from other adjacent light-emitting regions.

According to a first exemplary aspect of the present invention, there is provided a backlight driving method of a liquid crystal display device for illuminating, when a video signal is displayed on a liquid crystal panel, a corresponding display region on the liquid crystal panel by using each light-emitting block of a backlight which is divided into a plurality of light-emitting blocks each being able to independently emit light, the backlight driving method including:

a step of recording a predetermined rate of leakage of light leaked from a light-emitting block being adjacent to a given light-emitting block into a rear side of a display region corresponding to the given light-emitting block illuminated by the given light-emitting block into a recording unit so as to be readable for every light-emitting block based on a control signal component contained in the video signal and to be used for generating a lighting control signal in every light-emitting block, a step of detecting the control signal component contained in the video signal and to be used for generating a lighting control signal for every the light-emitting block, a step of letting the light-emitting block corresponding to the backlight emit light by the lighting control signal generated based on each of the detected control signal component, a step of measuring an intensity of light to be received for every light-emitting block, a step of reading the light leakage rate from the recording unit based on the detected control signal component, a step of calculating an amount of leakage of light leaked from the light-emitting block being adjacent to the given light-emitting block into the rear side of the display region corresponding to the given light-emitting block based on the control signal component detected in the adjacently-placed light-emitting block and on the read-out light leakage rate, and a step of correcting the emitted light from the given light-emitting block based on the detected control signal component, the measured light intensity, and calculated amount of light leakage, each corresponding to the given light-emitting block.

According to a second exemplary aspect of the present invention, there is provided a backlight driving method of a liquid crystal display device for illuminating, when a video signal is displayed on a liquid crystal panel, a corresponding display region on the liquid crystal panel by using each light-emitting block of a backlight which has been divided into a plurality of light-emitting blocks each being able to independently emit light, the backlight driving method including:

a step of recording, for the light-emitting block and so as to be readable, a predetermined amount of leakage of light leaked into a rear side of the display region corresponding to the given light-emitting block from an adjacently-placed light-emitting block occurring when the light-emitting block adjacent to a given light-emitting block is made to emit light according to a lighting control signal generated based on a control signal component;

a step of detecting the control signal component to be used for a lighting control signal from the video signal for every the light-emitting block;

a step of letting the light-emitting block corresponding to the backlight be made to emit light according to the lighting control signal generated based on each of the detected control signal component;

a step of measuring an intensity of light to be received for the light-emitting block;

a step of reading an amount of light leakage from the recording unit based on the detected control signal component; and a step of correcting the light emission from the given light-emitting block according to the detected control signal component, the measured intensity of light, the read amount of light leakage, each corresponding to the given light-emitting block.

According to a third exemplary aspect of the present invention, there is provided a backlight driving device of a liquid crystal display device having a liquid crystal panel to display a video signal and a backlight divided into a plurality of light-emitting blocks each being able to independently emit light which illuminates a corresponding display region on the liquid crystal panel by each of light-emitting blocks, including a recording unit to record a predetermined rate of leakage of light leaked from a light-emitting block being adjacent to a given light-emitting block into a rear side of a display region corresponding to the given light-emitting block illuminated by the given light-emitting block so as to be readable for every the light-emitting block based on a control signal component contained in the video signal and to be used for generating a lighting control signal for every light-emitting block, a detecting unit to detect the control signal component from the video signal and to be used for generating a lighting control signal for every light-emitting block, a light-emission control unit to let the corresponding light emitting block emit light by the lighting control signal generated based on each of the control signal component detected by the detecting unit, a measuring unit to measure an intensity of light to be received for every light-emitting block, a reading unit to read the light leakage rate from the recording unit based on the detected control signal component, a calculating unit to calculate an amount of leakage of light leaked from the light-emitting block being adjacent to the given light-emitting block into the rear side of the display region corresponding to the given light-emitting block based on the control signal component detected in the adjacently-placed light-emitting block and on the read-out light leakage rate, and a correcting unit to correct emitted light of the given light-emitting block based on the control signal component detected by the detecting unit, the light intensity measured by the measuring unit, and the amount of light leakage calculated by the calculating unit each corresponding to the given light-emitting block.

According to a fourth exemplary aspect of the present invention, there is provided a backlight driving device of a liquid crystal display device having a liquid crystal panel to display a video signal and a backlight divided into a plurality of light-emitting blocks each being able to independently emit light which illuminates a corresponding display region on the liquid crystal panel by each of the light-emitting blocks, including a recording unit to record, for the light-emitting block and so as to be readable, a predetermined amount of leakage of light leaked into a rear side of the display region corresponding to the given light-emitting block from a adjacently-placed light-emitting block occurring when the light-emitting block adjacent to a given light-emitting block is made to emit light according to a lighting control signal generated based on a control signal component contained in the video signal and to be used for generation of a lighting control signal for each light-emitting block, a detecting unit to detect the control signal component to be used for a lighting control signal from the video signal for every the light-emitting block, alight-emission control unit to let the corresponding light emitting block emit light by the lighting control signal generated based on each of the control signal component detected by the detecting unit, a measuring unit to measure an intensity of light received for every the light-emitting block, a reading unit to read the light leakage rate from the recording unit based on the detected control signal component, a correcting unit to correct emitted light of the given light-emitting block based on the control signal component detected by the detecting unit, the light intensity measured by the measuring unit, and the amount of light leakage read by the reading unit each corresponding to the given light-emitting block.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EXEMPLARY EMBODIMENTS

Best modes of carrying out the present invention will be described in further detail using various exemplary embodiments with reference to the accompanying drawings.

First Exemplary Embodiment

Figure 1:
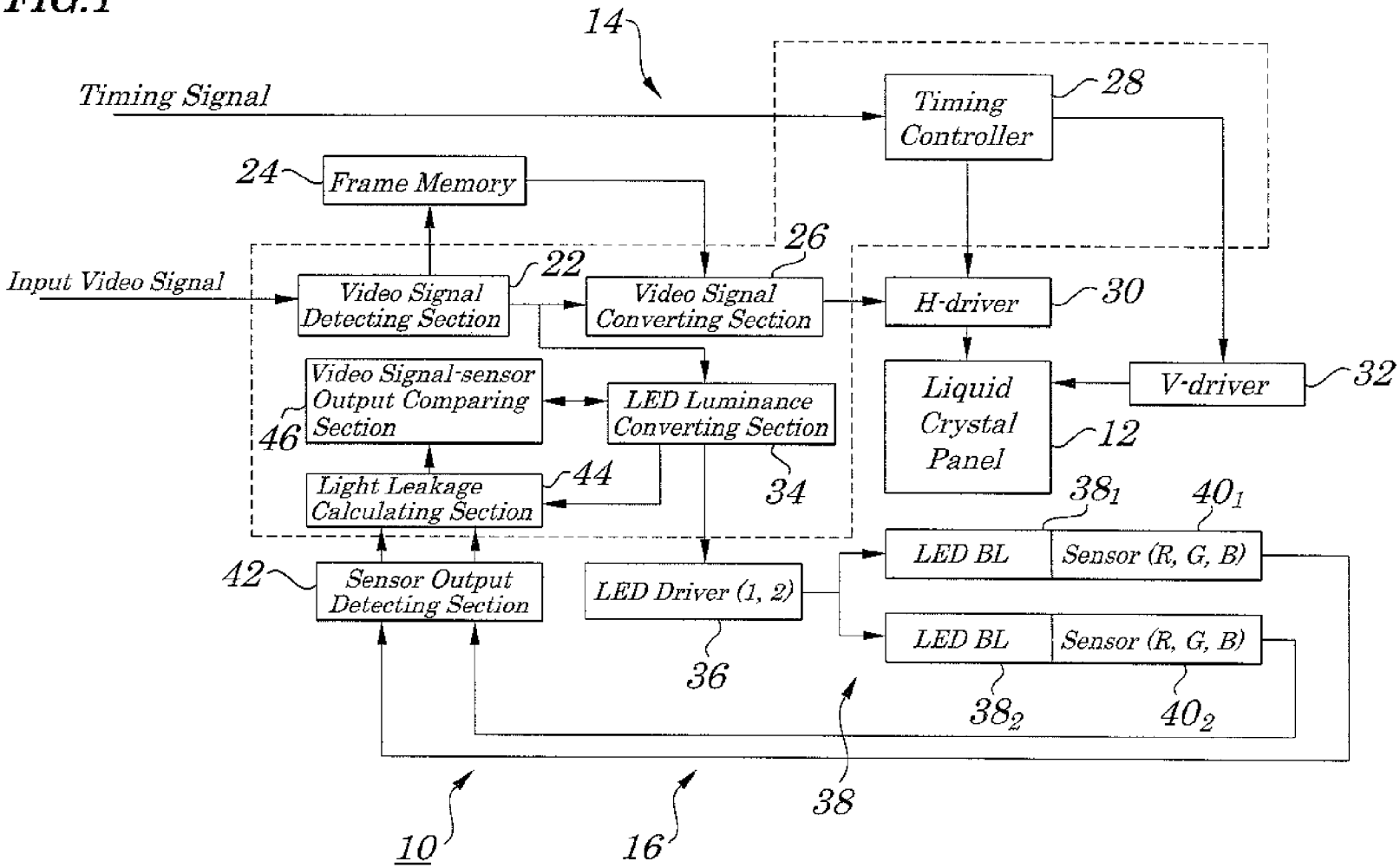
FIG. 1 is a diagram showing electrical configurations of a liquid crystal display device according to a first exemplary embodiment of the present invention.
Figure 2:
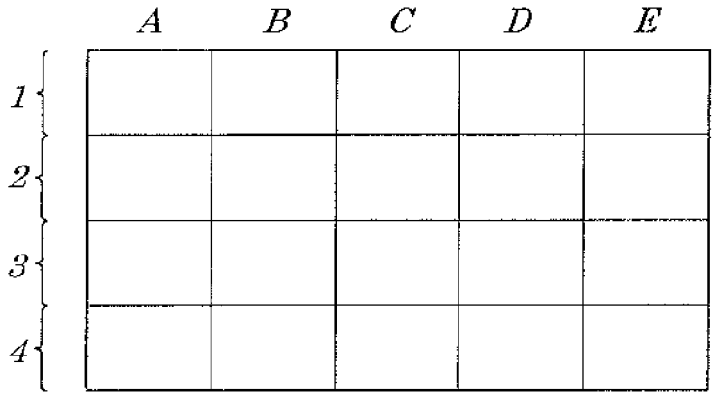
FIG. 2 is a diagram showing a backlight, which has been divided into 4 rows and 5 columns, of the liquid crystal display device of FIG. 1.
Figure 3:
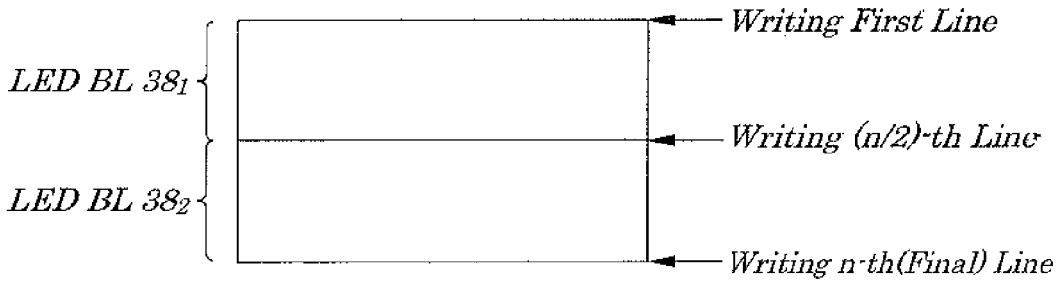
FIG. 3 is a diagram showing the backlight, which has been divided into two portions, of the liquid crystal display device of FIG. 1.
Figure 4:
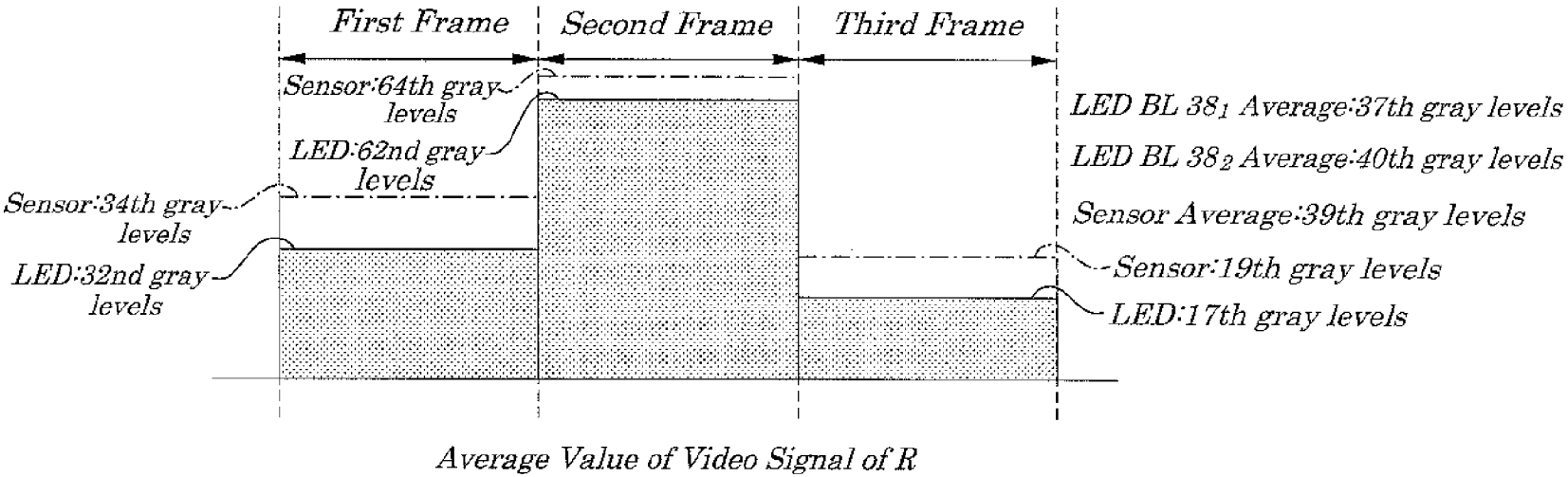
FIG. 4 is a time chart explaining a gray level of a red color of an R (Red) LED backlight and a sensor gray level of FIG. 1.
Figure 5:
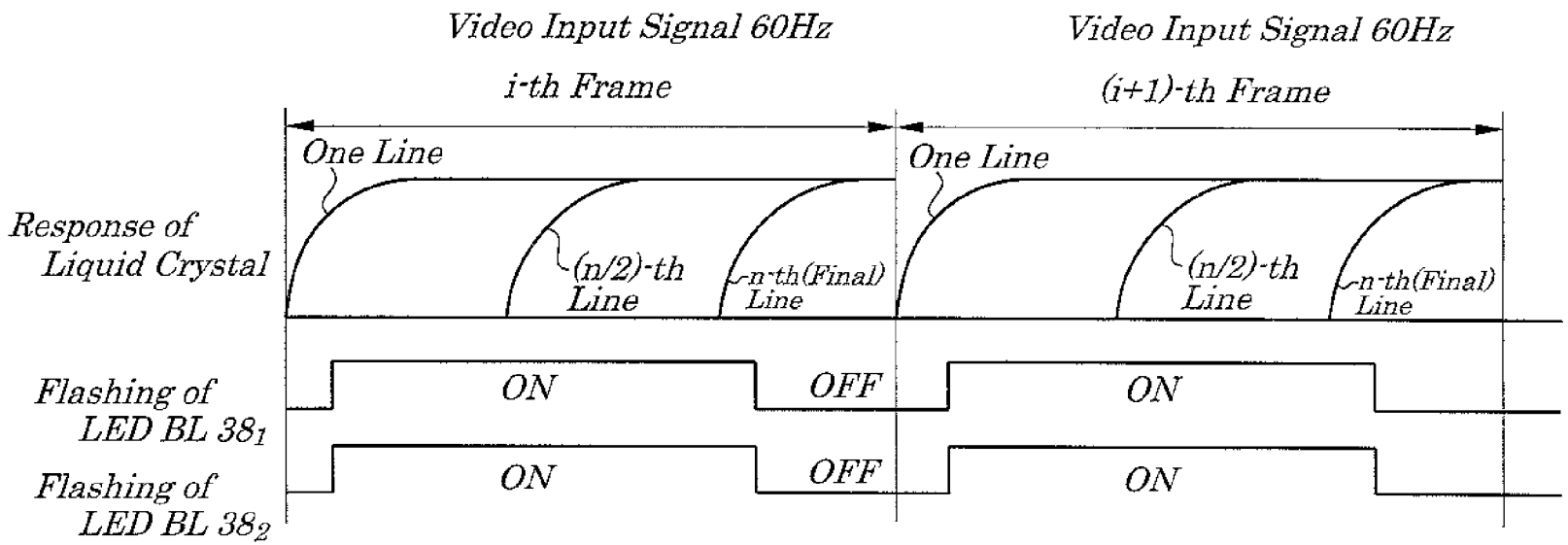
FIG. 5 is a time chart explaining a response of the liquid crystal display device of FIG. 1 and flashing of the LED backlight.

FIG. 1 is a diagram showing electrical configurations of a backlight driving device of a liquid crystal display device of the first exemplary embodiment of the present invention. FIG. 2 is a diagram showing the backlight, which has been divided into 4 rows and 5 columns, of the liquid crystal display device of FIG. 1. FIG. 3 is a diagram showing the backlight, which has been divided into two portions, of the liquid crystal display device of FIG. 1. FIG. 4 is a time chart explaining a gray level of a red color of R (Red) LED and a sensor gray level of FIG. 1. FIG. 5 is a time chart explaining a response of the liquid crystal display device of FIG. 1 and blinking time of the LED backlight. The liquid crystal display device 10 of the exemplary embodiment of the present invention is configured so that the backlight of the liquid crystal display device is divided into a plurality of light-emitting blocks (divided regions) and a display region corresponding to the liquid crystal panel is illuminated from each block in a manner to avoid an influence by the light leaked from other light-emitting blocks adjacent to a given light-emitting block to the display region being currently illuminated by the given light-emitting block. As shown in FIG. 1, the liquid crystal display device of the exemplary embodiment includes a pixel driving device 14 which sequentially applies a pixel signal to each pixel and a backlight driving device 16 which controls the backlight to illustrate the liquid crystal panel from a rear side of the liquid crystal panel 12.

The pixel driving device 14 chiefly includes a video signal detecting section 22, a frame memory 24, a video signal converting section 26, a timing controller 28, an H-driver 30 driving scanning lines, and a V-driver 32 driving signal lines. The video signal detecting section 22 makes up part of the pixel driving device 14 described above, which is configured so as to detect the maximum gray level of control signal component corresponding to the divided region (light-emitting block) described above from an input video signal to output the gray level to the video signal converting section 26 and to transmit the video signal to the frame memory 24. The frame memory 24 stores the video signal to be inputted.

An entire of the pixel driving device 14 is so configured that, according to data on the maximum gray level detected by the video signal detecting section 22 and the video signal outputted from the frame memory 24, the video signal converting section 26 converts a gray level of the video signal and sequentially feeds the converted video signal to the H-driver 30 by a line-sequentially driving method and the timing controller 28 receiving a timing signal from the outside feeds a timing signal letting the above pixel signal be sequentially applied to a corresponding signal line by the line-sequentially driving method to the H-driver 30 to which video signals are sequentially fed as described above in synchronization with the timing when the video signal converting section 26 feeds the above video signal to the H-driver 30 to which the above video signal is sequentially fed and also feeds a horizontal directional timing signal letting a scanning signal be sequentially applied to a scanning line by the line-sequentially driving method to the V-driver 32 to display an image corresponding to the video signal on a screen of the liquid crystal panel.

The backlight driving device 16 controls illuminating light required for displaying so as to be incident on the liquid crystal panel 12 from the rear side of the liquid crystal panel 12. The backlight driving device 16 is made up of an LED luminance converting section 34 to receive the gray level data detected by the video signal detecting section 22 described above, LED drivers (1, 2) 36, a first LED backlight (LED BL) $\mathbf{38}_1$, a second LED backlight (LED BL) $\mathbf{38}_2$, a first sensor (R, G, B) $\mathbf{40}_1$, a second sensor (R, G, B) $\mathbf{40}_2$, a sensor output detecting section 42, a light leakage calculating section 44, and a video signal-sensor output comparing section 46. The number of divisions of the backlight 38 is selected depending on an object and/or size of a monitor screen mainly displaying still images or TV (Television) screen mainly displaying moving images.

The LED luminance converting section 34 serves as a processing unit which converts luminance for letting an LED emit light (described later) and outputs a lighting control signal generated based on the conversion to the LED driver 36 and further stores at what gray level the light of R, G, and B of the LED is emitted in each of divided regions (light-emitting blocks) for each frame during given m (m=1, 2, 3, . . . ) frame periods and calculates an average value of the gray levels and outputs the value to the video signal-sensor output comparing section 46. Moreover, the process of converting luminance for letting the LED emit light to be performed by the LED luminance converting section 34 also includes a process of correcting the gray level correcting data itself. The LED driver 36 feeds a lighting control signal for letting an LED emit light using luminance data fed from the LED luminance converting section 34 to the LED backlights $\mathbf{38}_1$ and $\mathbf{38}_2$. The sensor (R, G, B) $\mathbf{40}_1$ and sensor (R, G, B) $\mathbf{40}_2$ detect a gray level of each of the Red, Green, and Blue of the LED backlights $\mathbf{38}_1$ and $\mathbf{38}_2$ respectively and output the detected gray level to the sensor output detecting section 42.

The sensor output detecting section 42 serves as a processing unit which calculates an average value of gray levels of each light component received from the sensor (R, G, B) $\mathbf{40}_1$ and sensor (R, G, B) $\mathbf{40}_2$ in every frame during m-frame periods and transfers the average value to the light leakage calculating section 44. The light leakage calculating section 44 serves as a processing unit which performs calculations of a gray level by using an amount of light leaked from other adjacently-placed divided regions (light-emitting block) to a rear face side of a display region (liquid crystal panel) corresponding to an attention-paid divided region being adjacent to the divided region taken into consideration and outputs results (average gray level calculated by taking light leakage into consideration) from the calculation to the video signal-sensor output comparing section 46. Here, the gray level is calculated by using the expression {(average gray level of sensor in attention-paid divided region [given divided region] of backlight 38)−(average gray level in each divided region adjacent to the attention-paid divided region)×(leakage rate of light "α" from adjacently-placed divided region being recorded in light leakage calculating section 44)}. The leakage rate of light, which is determined in advance, is recorded in a recording section of the light leakage calculating section 44 so as to be read out according to an output average gray level (described later).

The leakage rate of light is a value measured in advance. The leakage rate of light may be measured by using a given measuring method and the present invention is not limited to any measuring method. For example, the leakage rate of light from light-emitting blocks surrounding a given light-emitting region into a rear face (in an illuminated region of the above given light-emitting block) of a display region corresponding to the given light-emitting block is measured by using a trial product in a state in which the given light-emitting block is turned OFF and the measured leakage rate of light is recorded in advance in the light leakage calculating section 44 and the obtained leakage rate of light can be used when the liquid crystal display device 10 is driven. The video signal-sensor output comparing section 46 serves as a processing unit which compares an average gray level with a calculation result transmitted from the LED luminance converting section 34 and outputs gray level corrected data to the LED luminance converting section 34.

Next, driving of the backlight of the exemplary embodiment of the present invention is described by referring to FIGS. 1 to 5. The method of supplying a video signal to the liquid crystal panel 12 is the same as employed in the related technology. That is, not only the video signals to be inputted but also the timing signals from the H-driver 30 and V-driver 32 to drive the liquid crystal panel 12 are supplied from an unillustrated supplying portion.

The video signal detecting section 22, when a video signal is inputted thereto, stores the video signal into the frame memory 24 and detects the maximum gray level of an image of Red, Green, and Blue in each light-emitting block (divided region) corresponding to the divided LED backlight. If the backlight, as shown in FIG. 3, is divided into two portions, the video signal detecting section 22 detects the maximum gray level of each of the R, G, and B contained in the video signal in "1" line to "n/2" line and the maximum gray level of each of the R, G, and B contained in the video signal in "(n/2+1)" to the "n" line. Next, the video signal converting section 26 receiving the maximum gray level data from the video signal detecting section 22 and a video signal from the frame memory 24 is configured so as to change (convert) gray levels of colors contained in the video signal fed line-sequentially to the liquid crystal panel. Also, the LED luminance converting section 34 receiving the maximum gray level data from the video signal detecting section 22 is configured to change luminance of LEDs according to the maximum gray level (panel maximum gray level) assigned to a video signal and the maximum gray level (input maximum gray of video signal) to be detected. For example, when an input video signal is 6-bit (64 gray levels), that is, when the maximum gray level (panel maximum gray level) is 64th gray level, if the maximum gray level (input maximum gray level) to be detected is 32nd gray level, the video signal converting section 26 converts the 32nd gray level of an input video signal into the 64th gray level (input video signal: 32nd gray level×panel maximum gray level: 64th gray level/input maximum gray level: 32nd gray level) and also converts 10th gray level of an input video signal into 20th gray level (input video signal: 10th gray level×panel maximum gray level: 64th gray level/input maximum gray level: 32nd gray level).

The video signal whose gray level has been changed is sequentially fed to the H-driver 30. The timing controller 28 responding to a timing signal supplied from outside in synchronization with the timing (timing in a horizontal direction) when the video signal is fed to the H-driver 30 which receives a pixel signal supplied sequentially with the above horizontal directional timing is configured to supply a horizontal timing signal which causes the above pixel signal to be sequentially applied to a data line by the above-described line-sequential method to the H-driver and, on the other hand, feeds, by a line-sequential method, a timing signal which causes a scanning signal to be applied to a gate line of the liquid crystal panel 12 to the V-driver 32 to make an image corresponding to a video signal be displayed (that is, an video signal is written) on the screen of the liquid crystal panel 12.

Illuminating light to cause the data writing of the video signal is applied to the liquid crystal panel 12 from its rear face. This is described below. The gray level of the video signal is converted and, at the same time, the luminance of the LED is changed by the LED luminance converting section 34. When the detected maximum gray level (input maximum gray level) is 32nd gray level, the above conversion is made in a manner in which a luminance converting rate to any gray level of a video signal is 50% (input maximum gray level: 32nd gray level/panel maximum gray level: 64th level). The LED luminance converting section 34, in addition to the conversion of luminance, further stores at what gray level the light of R, G, and B of the LED is emitted in each of divided regions for each frame during given m (m=1, 2, 3, . . . ) frame periods and calculates an average value (output average gray level) of the gray level. The output average gray level is transferred to the light leakage calculating section 44 and the video signal-sensor output comparing section 46.

The lighting control signal to make light be emitted at the converted luminance is transmitted from the LED luminance converting section 34 to the LED driver 36. The LED driver 36 drives the backlights $\mathbf{38}_1$ and $\mathbf{38}_2$ in every frame to illuminate the liquid crystal panel 12 from its rear face. The light of each of the R, G, and B emitted from the backlights $\mathbf{38}_1$ and $\mathbf{38}_2$ driven to emit light is detected in every frame by the sensor (R, G, B) $\mathbf{40}_1$ and the sensor (R, G, B) $\mathbf{40}_2$ and an average gray level of the detected sensor output during m (m=1, 2, 3, . . . ) frame periods is calculated by the sensor output detecting section 42. An average gray level of the sensor during m (m=1, 2, 3, . . . ) frame periods thus calculated is transferred from the sensor output detecting section 42 to the light leakage calculation section 44.

The gray level is calculated in the light leakage calculating section 44 by using the expression {(average gray level of sensor in attention-paid divided region (attention-paid light emitting block) of backlight 38)−(average gray level in each divided region adjacent to the attention-paid divided region)× (pre-measured leakage rate of light "α" from adjacently-placed divided region being recorded in light leakage calculating section 44 into a rear side of a display region corresponding to the above attention-paid divided region)} and the gray level calculating data is outputted to the video signal-sensor output comparing section 46. The signal-sensor output comparing section 46 compares output average gray level data in the attention-paid divided region calculated by the LED luminance converting section 34 with gray level calculating data calculated by the light leakage calculating section 44 and a gray level correcting signal (gray level correcting data) corrected according to the comparison result is transferred to the LED luminance converting section 34. The LED luminance converting section 34 is configured to correct an output average gray level of the attention-paid divided region by the gray level corresponding to a gray level correcting signal, that is, makes an average gray level outputted from the LED luminance converting section 34 match up with the average gray level obtained by the light-leakage calculating section 44 and drives the attention-paid light emitting block by a lighting driving signal obtained after the correction.

Next, operations of the backlight driving device 16 made up of the LED luminance converting section 34, LED driver 36, backlights $\mathbf{38}_1$ and $\mathbf{38}_2$, light sensors $\mathbf{40}_1$ and $\mathbf{40}_2$, sensor output detecting section 42, light leakage calculating section 44, and video signal-sensor output comparing section 46 are described by using concrete examples.

For example, as shown in FIG. 4, when the LED luminance converting section 34 converts a gray level detected by the video signal detecting section 22 based on the maximum gray level (panel maximum gray level) assigned to the video signal and on the detected maximum gray level (input maximum gray level) and supplies a lighting control signal to cause light to be emitted at the obtained luminance to the LED drivers (1, 2) 36 to drive the LED backlight (LED BL) $\mathbf{38}_1$ and LED backlight (LED BL) $\mathbf{38}_2$, if a gray level (gray level used for lighting control) outputted from the R-RED in the LED backlight $\mathbf{38}_1$ in the first frame is 32nd gray level (LED: 32nd gray level in FIG. 4), if a gray level outputted from the R-RED in the LED backlight $\mathbf{38}_1$ in the second frame is 62nd gray level (LED: 62nd gray level in FIG. 4), and if a gray level outputted from the R-RED making up the LED backlight $\mathbf{38}_1$ in the third frame (LED: 17th gray level in FIG. 4) is 17th gray level, an average gray level outputted from the R-RED in the LED backlight $\mathbf{38}_1$ is 37th gray level (LED backlight $\mathbf{38}_1$: 37th gray level in FIG. 4). Also, in the case of the LED backlight (LED BL) $\mathbf{38}_2$, a gray level outputted from each of the R-REDs in each frame, that is, in each of the first, second and third frame periods is provided and it is assumed that an average gray level outputted from the R-RED making up the LED backlight $\mathbf{38}_2$ is 40th gray level (LED backlight $\mathbf{38}_2$: 40th gray level in FIG. 4).

Then, when the R-RED making up the LED backlight (LED BL1) $\mathbf{38}_1$ emits light at the output gray level described above, if a gray level outputted from the sensor (R) $\mathbf{40}_1$ in the first frame for the image is 34th gray level (sensor average: 34th gray level), if a gray level outputted from the sensor (R) $\mathbf{40}_1$ in the second frame for the image is 64th gray level (sensor average: 64th gray level), and if a gray level outputted from the sensor (R) $\mathbf{40}_1$ in the third frame for the image is 19th gray level (sensor average: 19th gray level), the sensor output detecting section 42 that receives output gray levels of these sensors outputs 39th gray level as an average gray level of the sensor during 3 frame periods (sensor average: 39th gray level in FIG. 4). Similarly, when the R-RED making up the LED backlight (LED BL2) $\mathbf{38}_2$ emits light, an average gray level of the sensor during 3 frame periods is outputted from the sensor output detecting section 42. The obtained average of the sensor during 3 frame periods for the R-RED making up the LED backlight $\mathbf{38}_2$ is outputted from the sensor output detecting section 42, however, the value is not required in the example and its description is omitted accordingly.

The light leakage calculating section 44 that receives an average gray level (40th gray level in the above example) outputted from the R-RED making up the LED backlight $\mathbf{38}_2$ from the LED luminance converting section 34 and an average gray level (in the above example, 39th gray level as the average gray level of the sensor during 3 frame periods) of the sensor during the m frame periods from the sensor output detecting section 42 reads out a light leakage rate "α" to be used for the gray level calculation from a recording section of the LED luminance converting section 34 based on the output gray level and performs calculation of the gray level to obtain an average gray level by taking the light leakage into consideration. By performing the calculation using the expression of {(average gray level of sensor (R) $\mathbf{40}_1$ during 3 frame periods outputted from the sensor output detecting section 42, for example, 39th gray level)−(average gray level outputted from R-RED making up LED backlight $\mathbf{38}_2$, for example, 40th gray level)×(light leakage rate "α" of light from R-RED making up LED backlight $\mathbf{38}_2$ into the rear face in the display region corresponding to LED backlight $\mathbf{38}_1$, for example, 10%)}, an average gray level obtained by taking light leakage rate into consideration, outputted from R-RED making up the LED backlight $\mathbf{38}_1$ is calculated (35th gray level in the example).

The calculated average gray level is transferred to the video Signal−sensor output comparing section 46, where the average gray level outputted from the R-RED making up the LED backlight $\mathbf{38}_1$, for example, 37th gray level, has already arrived from the LED luminance converting section 34 and, therefore, according to the exemplary embodiment of the present invention, the 35th gray level is compared with the average gray level outputted from the R-RED making up the LED backlight $\mathbf{38}_1$, for example, 37th gray level and, in the exemplary embodiment, the gray level correcting data obtained by lowering the output average gray level of the R-RED making up the LED backlight $\mathbf{38}_1$ by 2 gray levels is transmitted to the LED luminance converting section 34. The LED luminance converting section 34 corrects the gray level by an amount of the gray level correcting data, that is, makes the average gray level outputted from the LED luminance converting section 34 match up with the average gray level obtained by taking the light leakage into consideration calculated in the light leakage calculating section 44 and supplies a lighting control signal whose gray level has been corrected to the LED drivers (1, 2) 36 to emit light from the R-RED making up the LED backlight $\mathbf{38}_1$ at luminance corresponding to the light control signal at the timing shown in FIG. 5.

Moreover, in the above description, to simplify the description, only Red out of the Red, Green, and Blue is explained, however, the same processing of correcting gray levels for light leakage is performed, in parallel, on the Green and Blue as well.

Thus, according to the configurations of the exemplary embodiment, the influence by the light leaked from other adjacently-placed light-emitting blocks into a rear side of a display region corresponding to a given light-emitting block making up the backlight divided into a plurality portions is avoided, thereby suppressing lowering of contrast and modulation of an image caused by the light leakage. The effect of avoiding the influence by the light leakage acts effectively even when light emission intensity making up the backlight changes and, therefore, even if a change occurs in the light emission intensity of an LED, contrast and modulation of an image can be kept at a high level.

Second Exemplary Embodiment

Figure 6:
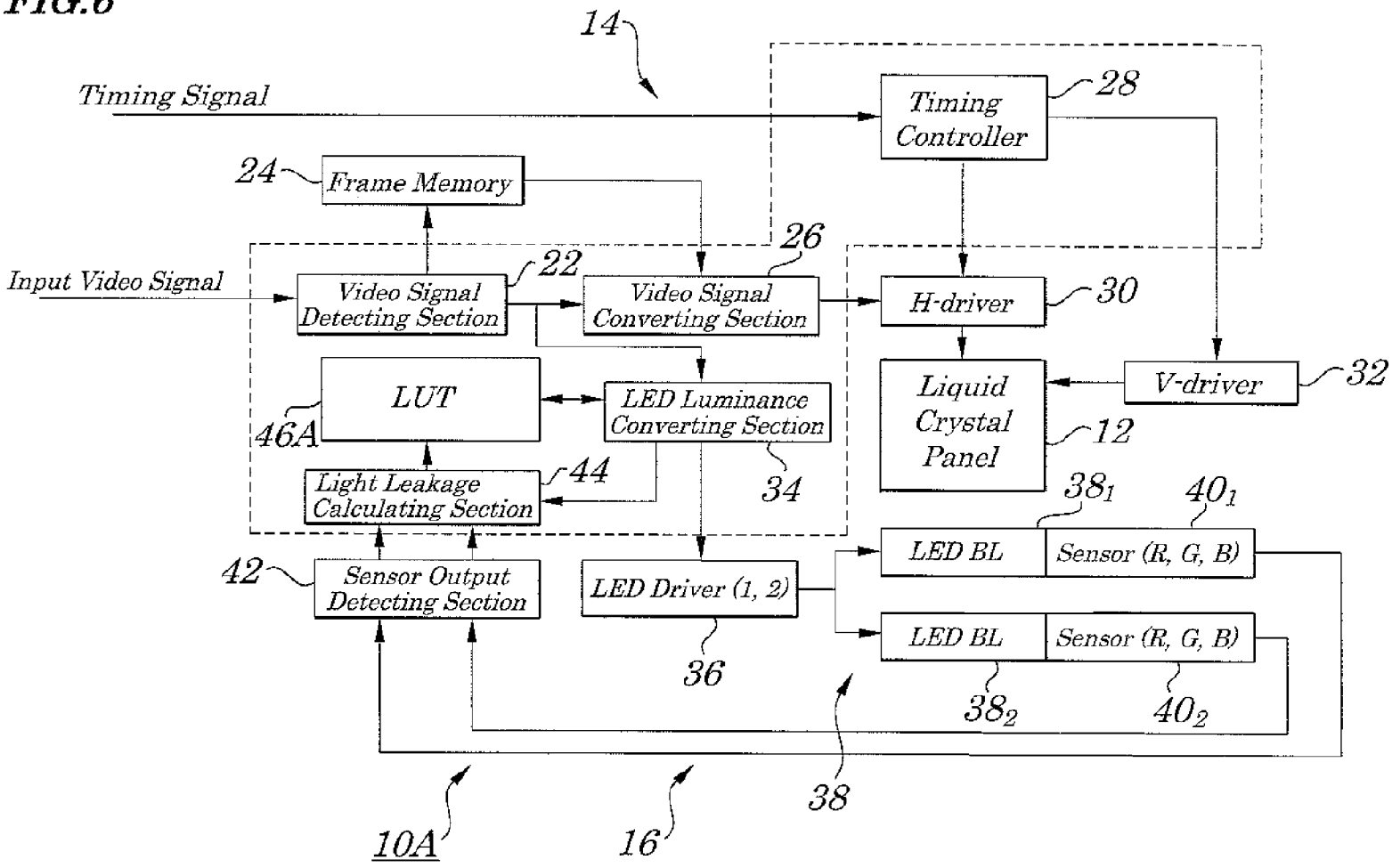
FIG. 6 is a diagram showing electrical configurations of a liquid crystal display device according to a second exemplary embodiment of the present invention.

FIG. 6 is a diagram showing electrical configurations of a liquid crystal display device of the second exemplary embodiment of the present invention. The configurations of the second exemplary embodiment differ greatly from those of the first exemplary embodiment in that an output average gray level of an LED backlight is compared with an average gray level calculated by taking light leakage into consideration by using a table. That is, the liquid crystal display device 10A of the second exemplary embodiment is featured by the configuration in which a lookup table 46A for retrieval is provided instead of the video signal–sensor output comparing section 46 employed in the first exemplary embodiment. In the lookup table 46A, a relationship among an output average gray level of an LED backlight, average gray level calculated by taking light leakage into consideration, and gray level correcting data are stored. The configurations of the second exemplary embodiment other than described above are the same as those in the first exemplary embodiment and, therefore, the same reference number is assigned to the same components and its sequential description is omitted accordingly.

Next, by referring to FIG. 6, operations of the second exemplary embodiment are described. Operations of the second exemplary embodiment are the same as those in the first exemplary embodiment except the following points. Operations of the second exemplary embodiment differ from those of the first exemplary embodiment in that, unlike in the first exemplary embodiment where the processing of correction of gray levels is performed by the comparison calculation between an output average gray level of the backlight and an average gray level obtained by taking light leakage into consideration, table retrieval using the lookup table 46A is employed. That is, an output average gray level calculated by the LED luminance converting section 34 and an average gray level obtained by taking light leakage into consideration are input to the lookup table 46A. In the lookup table 46A, retrieval is carried out on the above two average gray levels to output gray level correcting data. The gray level correcting data is transferred to the LED luminance converting section 34. In the LED luminance converting section 34, an average gray level calculated by being detected from a video signal and by being gray-level converted is corrected by an amount corresponding to gray level correcting data, that is, an average gray level provided by the light leakage calculating section 44 is made to match up with an output average gray level provided by the LED luminance converting section 34 and a lighting control signal which causes light to be emitted at luminance corresponding to the output average gray level obtained after the correction data is fed to the LED drivers (1, 2) 36. The LED backlight 38 is made to emit light at luminance corresponding to the lighting control signal with timing shown in FIG. 5 and gray levels are corrected.

Thus, according to configurations of the second exemplary embodiment, the influence by light leaked from other adjacently-placed light-emitting blocks to a rear side of a display region corresponding to a given light-emitting block out of backlights divided into a plurality of portions can be avoided and, as a result, the same effect as obtained in the first exemplary embodiment can be achieved.

While the invention has been particularly shown and described with reference to exemplary embodiments thereof, the invention is not limited to these exemplary embodiments. It will be understood by those of ordinary skill in the art that various changes in form and details may be made therein without departing from the sprit and scope of the present invention as defined by the claims. For example, the backlight driving system including the LED luminance converting section 34 to the LED drivers (1, 2) 36 may be configured that a lighting control signal is fed to the LED driver without converting luminance according to the gray level detected by the video signal detecting section 22. In this case also, the process of calculating an average gray level of the backlight to be driven and then correcting the average gray level is recommended.

The measurement of a light leakage rate may be achieved by employing another method. That is, an input video signal, instead of a video signal for light leakage measurement may be inputted to the video signal detecting section 22 and a lighting control signal which causes light to be emitted at luminance corresponding to a gray level of the video signal is fed from the LED luminance converting section 34 to the LED drivers (1, 2) 36. The light emitted from the backlight 38 according to a signal from the LED drivers (1, 2) 36 may be detected by the sensors $\mathbf{40}_1$ and $\mathbf{40}_2$ and is transferred to the light leakage calculating section 44 via the sensor output detecting section 42. In this case, the light leakage calculating section further may include a calculating section to calculate a rate of leakage of light leaked from an adjacently placed light-emitting blocks to a given light-emitting block according to each average gray level to be inputted from the sensor output detecting section 42 and its light leakage rate may be recorded in a recording region of the light leakage calculating section and may be used for calculating gray level correcting data. Moreover, by using the same method of measuring the light leakage rate as above, an amount of light leakage described above may be measured in advance, stored and used for correction of a gray level.

The video signal for measuring the light leakage rate may be configured in various manners. For example, the signal may be configured as an exclusively used signal or may be embedded in an ordinary video signal. Additionally, the light leakage rate may be derived theoretically from an optical structure of a backlight and from an optical waveguide expanding from a liquid crystal panel and backlight to a liquid crystal panel using another method of calculation and a value derived from the method may be used in the above embodiment. The LED luminance converting section 34, sensor output detecting section 42, light leakage calculating section 44, and video signal-output comparing section 46 may be so configured as to have various types. A desired amount of gray level correction may be derived from an output average gray level provided by a given light-emitting block fed from the LED luminance converting section 34, output average gray level provided by a light-emitting block being adjacent to a given light-emitting block, amount of leakage of light calculated from a light leakage rate being applied to calculation in the light leakage calculating section 44, amount of leakage of light obtained by the above-described alternate measuring method, and average gray level provided by a given light-emitting block outputted from the sensor output detecting section 42. In this configuration, for example, retrieval can be carried out on the recorded amount of light leakage by an output average gray level described above and the amount of light leakage is used for correcting light emission from an attention-paid light emitting block (divided region) by the same method as above, which falls within the technological range.

The method of driving the backlight of a liquid crystal display device, backlight driving device and liquid crystal display device disclosed here can be used for display devices of various types including an information processing device, personal digital assistant, video camera, cellular phone or a like and for a television set or the like.

What is claimed is:

1. A backlight driving device of a liquid crystal display device having a liquid crystal panel to display a video signal and a backlight divided into a plurality of light-emitting blocks each being able to independently emit light which illuminates a corresponding display region in said liquid crystal panel by each of said light-emitting blocks, comprising:

a recording unit to record in advance a rate of leakage of light leaked from a light-emitting block being adjacent to a given light-emitting block into a rear side of the display region corresponding to said given light-emitting block, when the adjacently placed light-emitting block is made to emit light, for every light-emitting block;

a detecting unit to detect and output a maximum gray level, which is a control signal component being used for generating a lighting control signal, from said video signal for every light-emitting block;

a light-emission control unit to let the corresponding light emitting block emit light by said lighting control signal generated based on each of said maximum gray level detected by said detecting unit; and a measuring unit to measure an intensity of light received for every light-emitting block;

a reading unit to read the light leakage rate from the adjacently placed light-emitting block from said recording unit;

a correcting unit to correct, for every said light-emitting block, emitted light of said given light-emitting block based on said maximum gray level for said adjacently placed light-emitting block output from said detecting unit, the light intensity for said given light-emitting block measured by said measuring unit, and said light leakage rate from said adjacently placed light-emitting block read by said reading unit, wherein said correcting unit comprises a detecting unit to output an average value obtained by averaging said gray levels, during a specified number of frame periods, corresponding to said light-emitting block out of gray levels to be detected in every frame of said video signal, the recording unit to record a rate of leakage of light leaked into the rear side of said display region corresponding to said given light-emitting block from said adjacently placed light emitting block, a first calculating unit to perform calculation of an equation (1), a second calculating unit to perform a calculation of comparison between said average value outputted by said detecting unit and a calculated value to be calculated by said first calculating unit, $$Lc=Lo-L2s\times\alpha \quad (1)$$

wherein "Lc" in the equation (1) denotes a calculated value of a gray level obtained by taking light leakage into consideration, "Lo" denotes an average value obtained by averaging gray levels, during the specified number of frame periods, measured in said light emitting block when said light emitting block is made to emit light by a lighting control signal generated based on a gray level to be detected in each frame of said video signal, "L2s" denotes an average value obtained by averaging gray levels, during the specified number of frame periods, to be used for generation of said light leaked into the rear side of said display region corresponding to said given light-emitting block from said adjacently placed light-emitting block when said given light-emitting block is made to emit light by a lighting control signal generated based on a gray level detected in each frame of said video signal, and "α" denotes a leakage rate of light leaked into the rear side of said display region corresponding to said given light-emitting block from an adjacently placed light emitting block.

2. The backlight driving device of the liquid crystal display device according to claim 1, wherein said detecting unit outputs an average value obtained by averaging maximum gray levels, during a specified number of frame periods, corresponding to each light-emitting block out of gray levels to be detected in each frame of said video signal.

3. The backlight driving device of the liquid crystal display device according to claim 1, wherein said measuring unit outputs an average value obtained by averaging gray levels, during a specified number of said frame periods, of said light measured for said given light-emitting block when said light-emitting block is made to emit light by a lighting control signal generated based on a gray level detected in every frame of said video signal.

4. The backlight driving device of the liquid crystal display device according to claim 1, wherein said lighting control signal is generated based on a value obtained by converting said gray level corresponding to said light-emitting block into specified luminance.

5. A liquid crystal display device comprising a liquid crystal panel, a backlight to illuminate said liquid crystal panel, and a backlight driving device to control light emission from said backlight wherein said backlight driving device comprises the backlight driving device as stated in claim 1.

6. A liquid crystal display device comprising:

a liquid crystal display device;

a panel driving unit to apply said video signal obtained by converting gray levels based on a gray level of a video signal to said liquid crystal panel; and a backlight driving device to control light emission from said backlight as stated in claim 1.

7. A backlight driving device of a liquid crystal display device having a liquid crystal panel to display a video signal and a backlight divided into a plurality of light-emitting blocks each being able to independently emit light which illuminates a corresponding display region in said liquid crystal panel by each of said light-emitting blocks, comprising:

a recording unit to record in advance a rate of leakage of light leaked from a light-emitting block being adjacent to a given light-emitting block into a rear side of the display region corresponding to said given light-emitting block, when the adjacently placed light-emitting block is made to emit light, for every light-emitting block;

a detecting unit to detect and output a maximum gray level, which is a control signal component being used for generating a lighting control signal, from said video signal for every light-emitting block;

a light-emission control unit to let the corresponding light emitting block emit light by said lighting control signal generated based on each of said maximum gray level detected by said detecting unit;

a measuring unit to measure an intensity of light received for every light-emitting block;

a reading unit to read the light leakage rate from the adjacently placed light-emitting block from said recording unit; and a correcting unit to correct, for every said light-emitting block, emitted light of said given light-emitting block based on said maximum gray level for said adjacently placed light-emitting block output from said detecting unit, the light intensity for said given light-emitting block measured by said measuring unit, and said light leakage rate from said adjacently placed light-emitting block read by said reading unit, wherein said correcting unit comprises a retrieving unit to retrieve a correspondence table based on an average value obtained by averaging said gray levels, during a specified number of said frame periods, corresponding to said light-emitting block out of gray levels to be detected in every frame of said video signal, value calculated from an equation (2), correspondence table between said average value and gray level correcting data determined the calculated value, $$Lc=Lo-L2s\times\alpha \quad (2)$$

wherein "Lc" in the equation (2) denotes a calculated value of a gray level obtained by taking light leakage into consideration, "Lo" denotes an average value obtained by averaging gray levels, during the specified number of frame periods, measured in said light emitting block when said light emitting block is made to emit light by a lighting control signal generated based on a gray level to be detected in each frame of said video signal, "L2s" denotes an average value obtained by averaging gray levels, during the specified number of frame periods, to be used for generation of said light leaked into the rear side of said display region corresponding to said given light-emitting block from said adjacently placed light-emitting block when said given light-emitting block is made to emit light by a lighting control signal generated based on a gray level detected in each frame of said video signal, and "α" denotes a leakage rate of light leaked into the rear side of said display region corresponding to said given light-emitting block from an adjacently placed light emitting block.

8. The backlight driving device of the liquid crystal display device according to claim 7, wherein said detecting unit outputs an average value obtained by averaging maximum gray levels, during a specified number of frame periods, corresponding to each light-emitting block out of gray levels to be detected in each frame of said video signal.

9. The backlight driving device of the liquid crystal display device according to claim 7, wherein said measuring unit outputs an average value obtained by averaging gray levels, during a specified number of said frame periods, of said light measured for said given light-emitting block when said light-emitting block is made to emit light by a lighting control signal generated based on a gray level detected in every frame of said video signal.

10. A backlight driving method of a liquid crystal display device for illuminating, when a video signal is displayed on a liquid crystal panel, a corresponding display region on said liquid crystal panel by using each light-emitting block of a backlight which has been divided into a plurality of light-emitting blocks each being able to independently emit light, said backlight driving method comprising:

a step of recording, into a recording unit, in advance a rate of leakage of light leaked from a light-emitting block being adjacent to a given light-emitting block into a rear side of the display region corresponding to said given light-emitting block, when the adjacently placed light-emitting block is made to emit light, for every light-emitting block;

a step of detecting and outputting a maximum gray level, which is a control signal component being used for generating a lighting control signal, from said video signal for every light-emitting block;

a step of letting said light-emitting block corresponding to said backlight be made to emit light according to said lighting control signal generated based on each of the detected maximum gray level;

a step of measuring an intensity of light to be received for every light-emitting block;

a step of reading the light leakage rate from the adjacently placed light-emitting block from said recording unit; and a step of correcting, for every said light-emitting block, emitted light of said given light-emitting block based on the detected and output maximum gray level for said adjacently placed light-emitting block, the measured light intensity for said given light-emitting block, and the read said light leakage rate from said adjacently placed light-emitting block, wherein, in said step of correcting, the correction of the light emission from said given light-emitting block is made based on an average value obtained by averaging gray levels, during a specified number of frame periods, corresponding to said light-emitting block out of gray levels to be detected in each frame of said given video signal and based on a result from a comparison calculation with a calculated value to be calculated from an equation (3), $$Lc=Lo-L2s\times\alpha \quad (3)$$

wherein "Lc" in the equation (3) denotes a calculated value of a gray level obtained by taking light leakage into consideration, "Lo" denotes an average value obtained by averaging gray levels, during the specified number of frame periods, measured in said light emitting block when said light emitting block is made to emit light by a lighting control signal generated based on a gray level to be detected in each frame of said video signal, "L2s" denotes an average value obtained by averaging gray levels to be used for generation of said light leaked into the rear side of said display region corresponding to said given light-emitting block from said adjacently placed light-emitting block when said given light-emitting block is made to emit light by a lighting control signal generated based on a gray level detected in each frame of said video signal, and "α" denotes a leakage rate of light leaked into the rear side of said display region corresponding to said given light-emitting block from an adjacently placed light emitting block.

11. The backlight driving method of the liquid crystal display device according to claim 10, wherein said step of detecting and outputting outputs an average value obtained by averaging maximum gray levels, during a specified number of frame periods, corresponding to each light-emitting block out of gray levels to be detected in each frame of said video signal.

12. The backlight driving method of the liquid crystal display device according to claim 10, wherein the intensity of said light has an average value obtained by averaging gray levels, during a specified number of frame periods, of the light to be measured for the given light-emitting blocks when said light-emitting block is made to emit light according to a lighting control signal generated for each of frame periods of said video signals based on a gray level detected.

13. The backlight driving method of the liquid crystal display device according to claim 10, wherein an amount of said light leakage is calculated based on an average value obtained by averaging gray levels, during a specified number of frame periods, of light leaked into the rear side of said display region corresponding to said given light-emitting block from said adjacently placed light emitting block when said adjacently placed light emitting block is made to emit light by a lighting control signal generated in every frame of said video signal based on a gray level to be detected.

14. The backlight driving method of the liquid crystal display device according to claim 10, wherein, in said step of correcting, the correction of the light emission from said given light-emitting block is made based on part or all of an average value obtained by averaging gray levels, during a specified number of frame periods, corresponding to said light-emitting block out of gray levels to be detected in each frame of said video signal, an average value obtained by averaging gray levels, during the specified number of frame periods, of light measured in said given light-emitting block when said light emitting block is made to emit light according to lighting control signal generated based on gray levels detected in every frame of said video signal, and an average value obtained by averaging gray levels, during the specified number of frame periods, to be used for generating said light leaked into the rear side of said display region corresponding to said given light-emitting block from the adjacently placed said light-emitting block when the adjacently placed said light emitting block is made to emit light by a lighting control signal generated based on a gray level detected in every frame of said video signal.

15. The backlight driving method of the liquid crystal display device according to claim 10, wherein said lighting control signal is generated based on a value obtained by converting said luminance corresponding to said light-emitting block into a specified luminance.

16. A backlight driving method of a liquid crystal display device for illuminating, when a video signal is displayed on a liquid crystal panel, a corresponding display region on said liquid crystal panel by using each light-emitting block of a backlight which has been divided into a plurality of light-emitting blocks each being able to independently emit light, said backlight driving method comprising:

a step of recording, into a recording unit, in advance a rate of leakage of light leaked from a light-emitting block being adjacent to a given light-emitting block into a rear side of the display region corresponding to said given light-emitting block, when the adjacently placed light-emitting block is made to emit light, for every light-emitting block;

a step of detecting and outputting a maximum gray level, which is a control signal component being used for generating a lighting control signal, from said video signal for every light-emitting block;

a step of letting said light-emitting block corresponding to said backlight be made to emit light according to said lighting control signal generated based on each of the detected maximum gray level;

a step of measuring an intensity of light to be received for every light-emitting block;

a step of reading the light leakage rate from the adjacently placed light-emitting block from said recording unit; and a step of correcting, for every said light-emitting block, emitted light of said given light-emitting block based on the detected and output maximum gray level for said adjacently placed light-emitting block, the measured light intensity for said given light-emitting block, and the read said light leakage rate from said adjacently placed light-emitting block, wherein, in said step of correcting, the correction of the light emission from said given light-emitting block is made based on an average value obtained by averaging gray levels, during a specified number of frame periods, corresponding to said light-emitting block out of gray levels to be detected in every frame of said video signal, a calculated value calculated from an equation (4), and gray level correction data outputted by retrieving an average value and calculated value from a correspondence table containing said gray level correcting data determined from said average value and calculated value, $$Lc=Lo-L2s\times\alpha \quad (4)$$

wherein "Lc" in the equation (4) denotes a calculated value of a gray level obtained by taking light leakage into consideration, "Lo" denotes an average value obtained by averaging gray levels, during the specified number of frame periods, measured in said light emitting block when said light emitting block is made to emit light by a lighting control signal generated based on a gray level to be detected in each frame of said video signal, "L2s" denotes an average value obtained by averaging gray levels, during the specified number of frame periods, to be used for generation of said light leaked into the rear side of said display region corresponding to said given light-emitting block from said adjacently placed light-emitting block when said given light-emitting block is made to emit light by a lighting control signal generated based on a gray level detected in each frame of said video signal, and "α" denotes a leakage rate of light leaked into the rear side of said display region corresponding to said given light-emitting block from an adjacently placed light emitting block.

17. The backlight driving method of the liquid crystal display device according to claim 16, wherein said step of detecting and outputting outputs an average value obtained by averaging maximum gray levels, during a specified number of frame periods, corresponding to each light-emitting block out of gray levels to be detected in each frame of said video signal.

18. The backlight driving method of the liquid crystal display device according to claim 16, wherein the intensity of said light has an average value obtained by averaging gray levels, during a specified number of frame periods, of the light to be measured for the given light-emitting blocks when said light-emitting block is made to emit light according to a lighting control signal generated for each of frame periods of said video signals based on a gray level detected.

* * * * *